US010556316B2

(12) United States Patent
Lugg et al.

(10) Patent No.: US 10,556,316 B2
(45) Date of Patent: Feb. 11, 2020

(54) POLISHING PADS AND SYSTEMS FOR AND METHODS OF USING SAME

(71) Applicant: 3M INNOVATIVE PROPERTIES COMPANY, St. Paul, MN (US)

(72) Inventors: Paul S. Lugg, Woodbury, MN (US); Bruce A. Sventek, Woodbury, MN (US); Lian S. Tan, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 81 days.

(21) Appl. No.: 15/573,509

(22) PCT Filed: May 11, 2016

(86) PCT No.: PCT/US2016/031723
§ 371 (c)(1),
(2) Date: Nov. 13, 2017

(87) PCT Pub. No.: WO2016/183126
PCT Pub. Date: Nov. 17, 2016

(65) Prior Publication Data

US 2018/0154497 A1 Jun. 7, 2018

Related U.S. Application Data

(60) Provisional application No. 62/161,022, filed on May 13, 2015.

(51) Int. Cl.
*B24B 37/26* (2012.01)
*B24B 37/04* (2012.01)
*B24B 37/10* (2012.01)

(52) U.S. Cl.
CPC ..... *B24B 37/044* (2013.01); *B24B 37/105* (2013.01); *B24B 37/26* (2013.01)

(58) Field of Classification Search
CPC ..... B24B 37/04; B24B 37/10; B24B 37/26; B24B 37/044; B24B 37/105
(Continued)

(56) References Cited

U.S. PATENT DOCUMENTS 3,036,003 A 5/1962 Verdol
3,236,770 A 2/1966 Matson
(Continued)

FOREIGN PATENT DOCUMENTS

WO WO 2015-047939 4/2015
WO WO 2015-048011 4/2015

OTHER PUBLICATIONS

Kasman, "Waste Reduction in Lapping Sapphire and Other Compound Semiconductor Materials", CS Mantech Conference, May 17-20, 2010, Portland, Oregon, USA, pp. 1-4.
(Continued)

*Primary Examiner* — Robert A Rose
(74) *Attorney, Agent, or Firm* — Adam Bramwell

(57) ABSTRACT

A polishing system includes a first carrier assembly configured to receive and hold a substrate and a polishing pad. The polishing pad includes a top major surface and a bottom major surface positioned opposite the top major surface, and a plurality of polishing elements extending from the top major surface of the polishing pad. The system further includes a polishing solution disposed between the top surface of the polishing pad and the substrate. The polishing fluid includes a fluid component, and a plurality of ceramic abrasive composites dispersed in the fluid component, the ceramic abrasive composites including individual abrasive particles dispersed in a porous ceramic matrix. The system further includes a second carrier assembly configured to receive and hold the polishing pad. The system is configured
(Continued)

such that the polishing pad is movable relative to the substrate to carry out a polishing operation.

19 Claims, 1 Drawing Sheet

(58) Field of Classification Search
USPC ..... 451/287–290, 41, 527, 526
See application file for complete search history.

(56) References Cited

U.S. PATENT DOCUMENTS

| | | | | |
|---|---|---|---|---|
| 3,275,554 | A | 9/1966 | Wagenaar | |
| 3,414,347 | A | 12/1968 | Stoltze | |
| 3,438,757 | A | 4/1969 | Honnen | |
| 3,448,047 | A | 6/1969 | Traise | |
| 3,454,555 | A | 7/1969 | Voort | |
| 3,461,172 | A | 8/1969 | Previc | |
| 3,539,633 | A | 11/1970 | Piasek | |
| 3,565,804 | A | 2/1971 | Honnen | |
| 3,586,629 | A | 6/1971 | Otto | |
| 3,591,598 | A | 7/1971 | Traise | |
| 3,634,515 | A | 1/1972 | Piasek | |
| 3,725,480 | A | 4/1973 | Traise | |
| 3,726,882 | A | 4/1973 | Traise | |
| 3,980,569 | A | 9/1976 | Pindar | |
| 5,157,088 | A | 10/1992 | Dishong | |
| 5,256,752 | A | 10/1993 | Dishong | |
| 5,395,539 | A | 3/1995 | Chandler | |
| 5,766,277 | A | 6/1998 | DeVoe | |
| 6,319,108 | B1 | 11/2001 | Adefris | |
| 6,470,540 | B2 | 10/2002 | Aamodt | |
| 6,551,366 | B1 | 4/2003 | D'Souza | |
| 6,579,162 | B2 * | 6/2003 | Chesley | A44B 18/00 428/106 |
| 6,908,366 | B2 | 6/2005 | Gagliardi | |
| 7,226,345 | B1 | 6/2007 | Dornfeld | |
| 2012/0315830 | A1 | 12/2012 | Joseph | |

OTHER PUBLICATIONS

Ng, "Advancements in Lapping and Polishing with Diamond Slurries", CS Mantech Conference, Apr. 23-26, 2012, Boston, Massachusetts, USA, pp. 1-4.

International Search Report for PCT International Application No. PCT/US2016/031723, dated Aug. 11, 2016, 3 pages.

* cited by examiner

POLISHING PADS AND SYSTEMS FOR AND METHODS OF USING SAME

CROSS REFERENCE TO RELATED APPLICATION

This application is a national stage filing under 35 U.S.C. 371 of PCT/US2016/031723, filed May 11, 2016, which claims the benefit of U.S. Provisional Application No. 62/161,022, filed May 13, 2015, the disclosure of which is incorporated by reference in its/their entirety herein.

FIELD

The present disclosure relates to polishing pads useful for the polishing of substrates, and systems for and methods of using such polishing pads.

BACKGROUND

Various articles, systems, and methods have been introduced for the polishing of ultrahard substrates. Such articles, systems, and methods are described, for example, in E. Kasman, M. Irvin, CS Mantech Conference, May 17-20$^{th}$ 2010, Portland Oreg.; and K. Y. Ng, T. Dumm, CS Mantech Conference, April 23rd-26th, Boston , Mass.

SUMMARY

In some embodiments, a system for polishing a substrate is provided. The system includes a first carrier assembly configured to receive and hold the substrate and a polishing pad. The polishing pad includes a top major surface and a bottom major surface positioned opposite the top major surface, and a plurality of polishing elements extending from the top major surface of the polishing pad. The system further includes a polishing solution disposed between the top surface of the polishing pad and the substrate. The polishing fluid includes
a fluid component, and a plurality of ceramic abrasive composites dispersed in the fluid component, the ceramic abrasive composites including individual abrasive particles dispersed in a porous ceramic matrix. The system further includes a second carrier assembly configured to receive and hold the polishing pad. The polishing pad is coupled to the second carrier assembly such that the top surface of the polishing pad is adjacent a surface of the substrate, and the system is configured such that the polishing pad is movable relative to the substrate to carry out a polishing operation.

In some embodiments, a method for polishing the surface of a substrate is provided. The method includes providing a substrate having a major surface to be polished, providing the above-described system for polishing a substrate, and contacting the major surface of the substrate with the polishing pad and the polishing solution while there is relative motion between the polishing pad and the major surface of the substrate.

The above summary of the present disclosure is not intended to describe each embodiment of the present disclosure. The details of one or more embodiments of the disclosure are also set forth in the description below. Other features, objects, and advantages of the disclosure will be apparent from the description and from the claims.

BRIEF DESCRIPTION OF THE DRAWINGS

The disclosure may be more completely understood in consideration of the following detailed description of various embodiments of the disclosure in connection with the accompanying figures, in which.

DETAILED DESCRIPTION

Definitions

As used herein, the singular forms "a", "an", and "the" include plural referents unless the content clearly dictates otherwise. As used in this specification and the appended embodiments, the term "or" is generally employed in its sense including "and/or" unless the content clearly dictates otherwise.

As used herein, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

Currently, ultrahard substrate (e.g., sapphire substrates) finishing processes are fixed abrasive processes or abrasive processes that involve the use of abrasive charged metal plates followed by chemical mechanical polishing with colloidal silica slurry. The challenges of lapping and polishing ultrahard substrates have not been satisfied using known versions of such processes. For example, inadequate material removal rates, poor surface finish, sub surface damage, high cost, and overall process difficulty have all been associated with such known processes.

The present disclosure is directed to articles, systems, and methods useful for polishing ultrahard substrates that overcomes many of the aforementioned problems associated with conventional abrasive processes.

Figure 1:
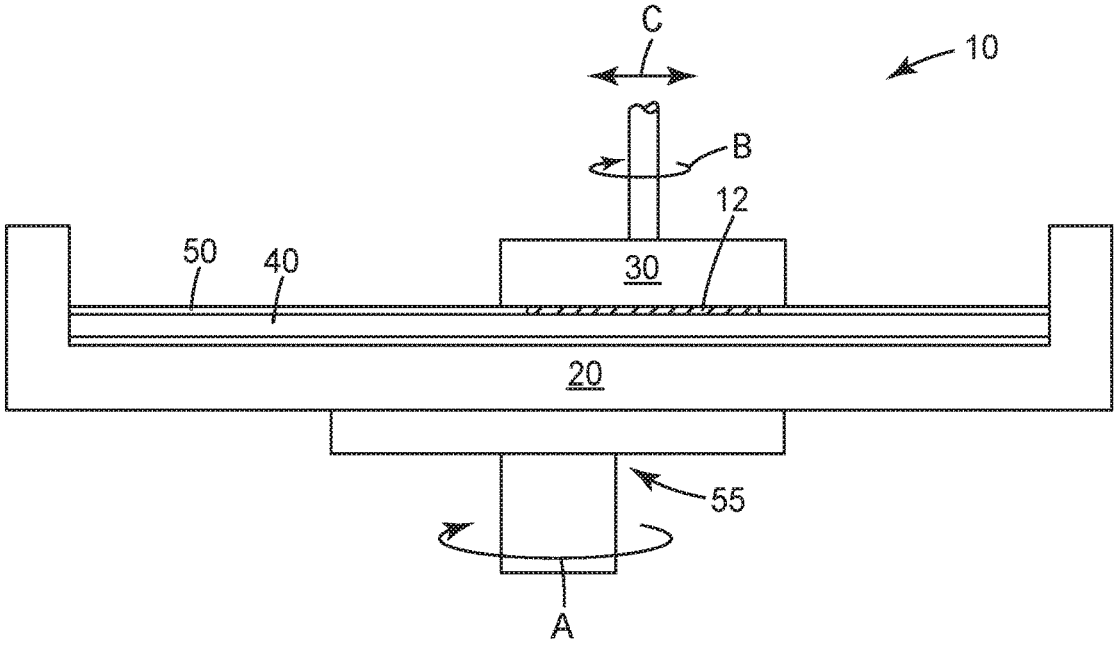
FIG. 1 illustrates a schematic of an example of a polishing system in accordance with some embodiments of the present disclosure.

Mechanical and chemical-mechanical planarization processes remove material from the surface of, or polish, substrates (e.g., semiconductor wafers, field emission displays, and many other microelectronic substrates) to form a flat surface at a desired elevation in the substrates. Such processes may also be used to polish curved or arcuate surfaces, such as a curved edge of a substrate, or a curved surface that defines an aperture in a substrate. FIG. 1 schematically illustrates an example of a polishing system 10 for utilizing articles and methods in accordance with some embodiments of the present disclosure. As shown, the system 10 may include a carrier assembly 20 configured to receive and hold a polishing pad 40, (typically, a platen), a carrier assembly 30 configured to receive and hold a substrate to be polished, and a layer of a polishing solution 50 disposed about a major surface of the polishing pad 40. During operation of the polishing system 10, a drive assembly 55 may rotate (arrow A) the carrier assembly 20 to move the polishing pad 40 to carry out a polishing operation. The polishing pad 40 and the polishing solution 50 may separately, or in combination, define a polishing environment that mechanically and/or chemically removes material from or polishes a surface of a substrate 12. The polishing solution 50 may be provided to the polishing system 10 at a desired rate (which can be varied) via a suitable delivery mechanism (e.g., a pump). To polish the surface of the substrate 12 with the polishing system 10, the carrier assembly 30 may press the substrate 12 against a polishing surface of the polishing pad 40 in the presence of the polishing solution 50. The carrier assembly 20 (and thus the polishing pad 40) and/or the carrier assembly 30 then move relative to one another to translate the substrate 12 across the polishing surface of the polishing pad 40. The carrier assembly 30 may rotate (arrow B) and optionally transverse laterally (arrow C). As a result, the abrasive particles (which may be contained in the polishing pad 40 and/or the polishing solution 50) and/or the chemicals in the polishing environment remove material from the surface of the substrate 12. It is to be appreciated that the polishing system 10 of FIG. 1 is only one example of a polishing system that may be employed in connection with the articles and methods of the present disclosure, and that other conventional polishing systems may be employed without deviating from the scope of the present disclosure.

Figure 2A:
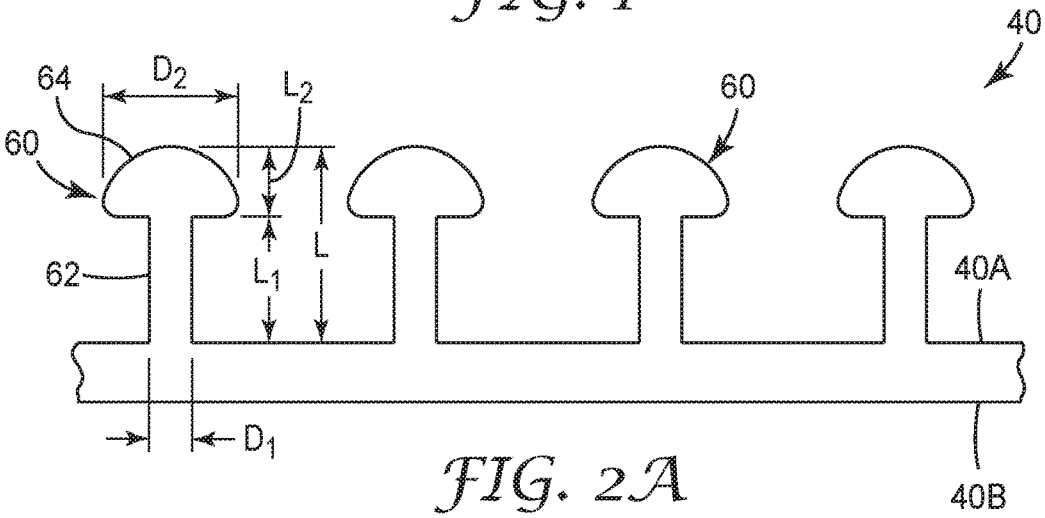
FIG. 2A-2D illustrate a schematic cross-sectional views of polishing pads in accordance with some embodiments of the present disclosure.

Referring now to FIG. 2A, a polishing pad 40 according to some embodiments of the present disclosure is illustrated. As shown, the polishing pad 40 may include a base layer of material having a top major surface 40A and a bottom major surface 40B (e.g., top and bottom major substantially planar surfaces). As used herein, a top major surface of a polishing pad, or top major surface of a polishing pad layer, refers to a surface of the pad or a pad layer that is intended to contact the substrate to be polished during a polishing operation.

In some embodiments, the polishing pads may include a plurality of polishing elements 60 extending from the base layer. Generally, the polishing elements 60 may be configured to contact and facilitate polishing of substrates having a surface contour (e.g., curved surfaces, surface indentations, and the like). As shown, the plurality of polishing elements 60 may extend from the top major surface 40A of the polishing pad 40 in a direction that is substantially normal to the top major surface 40A (alternatively, the polishing elements 60 may extend from the top major 40A at any desired angle). In some embodiments, the polishing elements 60 may include a first portion, or stem 62, and a second portion, or polishing head 64, which is positioned distally with respect to the stem 62. Referring still to FIG. 2A, the stems 62 may have a height L1 (i.e., longest dimension in a direction substantially normal to the major surface 40A) and a thickness D1 (i.e., longest dimension in a direction generally parallel to the major surface 40A), and the polishing heads 64 may have a height L2 (i.e., longest dimension in a direction substantially normal to the major surface 40A that the polishing head extends from a distal end of the stem 62) and a thickness D2 (i.e., longest dimension in a direction generally parallel to the major surface 40A).

In some embodiments, the stems 62 may be integrally formed with the base layer of the polishing pad 40. Alternatively, the stems 62 may be coupled to the base layer by any suitable fastening mechanism (e.g., adhesive, heat bond, clamping). The stems 62 may extend from theGenerally, the stems 62 may be configured to impart flexion to the polishing elements 60 such that the polishing elements 60 may bend to accommodate the polishing of substrates having a surface contour. In this regard, the stems 62 may have a height to thickness ratio (L1/D1) of at least 10, at least 5, or at least 3, or between 10 and 20, between 5 and 10, or between 3 and 5. Alternatively, the stems 62 may be configured to impart rigidity to the polishing elements 60.

In some embodiments, the stems 62 may have a height (L1) of between 3 mm and 0.01 mm, between 2 mm and 0.2 mm, or between 1.2 mm and 0.5 mm; and a thickness (D1) of between of between 0.5 mm and 0.01 mm, between 0.3 mm and 0.05 mm, or between 0.2 mm and 0.1 mm. In some embodiments, the height and/or thicknesses of the stems 62 may be the same relative to one another. Alternatively, the height and/or thicknesses of the stems 62 may vary throughout the pad 40 in a random or organized fashion. The stems 62 may have a cross-section along their height (L1) that is circular, square, rectangular, or any other suitable cross-sectional shape. The cross-section of the stems 62 may be uniform along their height (L1) or vary along their length (e.g, the stems 62 may taper along their height in either or both directions).

Figure 2B:
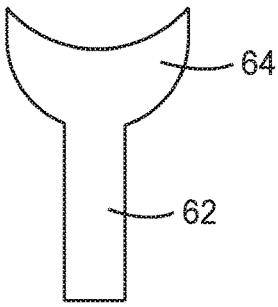
Figure 2C:
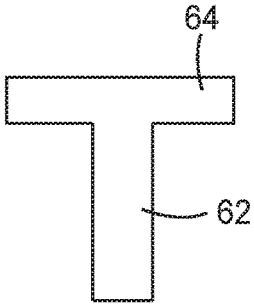
Figure 2D:
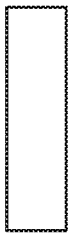

In some embodiments, referring still to FIG. 1A, the polishing heads 64 may have a height (L2) of between 0.1 mm and 0.7 mm, between 0.2 mm and 0.6 mm, or between 0.3 mm and 0.5 mm, and a thickness (D2) of between of between 0.1 mm and 1.5 mm, between 0.2 mm and 1.0 mm, or between 0.5 mm and 0.7 mm. In some embodiments, the height and/or thicknesses of the polishing heads 64 may be the same relative to one another or, alternatively, may vary throughout the pad 40 in a random or organized fashion. The polishing heads 64 may have a cross-sectional shape that is convex (e.g., spherical, hemispherical, or the like) as shown in FIG. 2A. Alternatively, the polishing heads 64 may have a cross-sectional shape that is concave or cup shaped as shown in FIG. 2B. As a further alternative, the polishing heads 64 may have a cross-sectional shape that is rectangular (as shown in FIG. 2C), square, or any other desired cross-sectional shape. In one embodiment, as shown in FIG. 2D, the polishing heads 64 may have a cross-sectional shape that is substantially similar to that of the polishing stems (that is, the distal end of the stem may serve as the polishing head). The size and shape of the polishing heads 64 may be the same relative to one another or, alternatively, may vary throughout the pad 40 in a random or organized fashion.

In various embodiments, the polishing elements 60 may be uniformly distributed, that is, have a single areal density (i.e., number of polishing elements per unit area), across the top major surface 40A, or may have an areal density that varies across the top major surface 40A in a random or organized fashion. The areal density of the polishing elements 60 may be between 800/cm$^2$ and 50/cm$^2$, between 500/cm$^2$ and 100/cm$^2$, or between 300/cm$^2$ and 150/cm$^2$.

In illustrative embodiments, the polishing elements 60 may be arranged randomly across the top major surface 40A or may be arranged in a pattern, e.g. a repeating pattern, across the top major surface 40A. Patterns include, but are not limited to, square arrays, hexagonal arrays and the like. A combination of patterns may also be employed.

In various embodiments, one or more of the polishing pad layers may include, in addition to a plurality of polishing elements 60, a plurality of cavities that extend into the polishing pad 40 from either or both of the top and bottom major surfaces 40A, 40B. The cavities may extend into the polishing pad any desired distance (including entirely through the polishing pad and, thereby, permit flow of slurry through the cavities). The cavities may have any size and shape. For example, the shape of the cavities may be selected from among a number of geometric shapes such as a cubic, cylindrical, prismatic, hemispherical, rectangular, pyramidal, truncated pyramidal, conical, truncated conical, cross, post-like with a bottom surface which is arcuate or flat, or combinations thereof. Alternatively, some or all of the cavities may have an irregular shape. In some embodiments, each of the cavities has the same shape. Alternatively, any number of the cavities may have a shape that is different from any number of the other cavities. The cavities can be provided in an arrangement in which the cavities are aligned in rows and columns, distributed in a pattern (e.g., spiral, helix, corkscrew, or lattice fashion), or distributed in a "random" array (i.e., not in an organized pattern).

In illustrative embodiments, the polishing pads of the present disclosure, including the polishing elements, may include or be formed of a polymeric material. For example, the polishing pads may be formed from thermoplastics, for example; polypropylene, polyethylene, polycarbonate, polyurethane, polytetrafluoroethylene, polyethylene teraphthalate, polyethylene oxide, polysulphone, polyetherketone, polyetheretherketone, polyimides, polyphenylene sulfide, polystyrene, polyoxymethylene plastic, and the like; thermosets, for example polyurethanes, epoxy resin, phenoxy resins, phenolic resins, melamine resins, polyimides and urea-formaldehyde resins, radiation cured resins, or combinations thereof. In some embodiments, the polishing pads, including the polishing elements, may include or be formed of a propylene polymer resin such as those available under the trade names Phillips HGZ-180 and Phillips HGX-030-01 from Phillips Sumika Polypropylene Company, Houston, Tex. In some embodiments, the polishing pads may be formed from a soft metal material such as, for example copper, tin, zinc, silver, bismuth, antimony, or alloys thereof. The polishing pad pads may consist essentially of only one layer of material, or may have a multilayered construction.

In some embodiments, the polishing elements may be formed of a material that is distinct from the material of the base layer. For example, the polishing elements may be formed of artificial materials such as nylon, polyphenylene sulfide, polyethylene, polypropylene, polycarbonate, polyurethane, polymer blends, filled polymer materials having carbon black or inorganic or metallic fillers. Additionally, or alternatively, polishing elements may be formed of natural fibrous materials such as animal hair (e.g, pig hair, camel hair, wool).

The polishing pads may have any shape and thickness. The thickness of the polishing pads may influence the stiffness of pads which, in turn, can affect polishing results, particularly the planarity and/or flatness of the substrate being polished. In some embodiments, the thickness of the polishing pad (i.e., distance between the top and bottom major surfaces of the polishing pad) may be less than 10 mm, less than 5 mm, less than 2.5 mm, less than 1 mm, less than 0.5 mm, less than 0.25 mm, less than 0.125 mm, or less than 0.05 mm. In some embodiments, the thickness of the polishing pad is greater than 0.125 mm, greater than 0.25 mm, greater than 0.50 mm, greater than 0.75 mm or even greater than 1 mm. In some embodiments the thickness of the polishing pad ranges between 0.125 mm and 10 mm, between 0.2 mm and 7 mm, or between about 0.25 mm and 5 mm. In some embodiments, the shape of the polishing pad may conform to the shape of the carrier assembly upon which the polishing pad is to be mounted. For example, the polishing pad may be configured in the shape of a circle or annulus having a diameter that corresponds to the diameter of a platen upon which the multi-layered polishing pad is to be mounted. In some embodiments, the polishing pad may conform to the shape of the carrier assembly (e.g., platen) within a tolerance of ±10%.

As will be appreciated by those skilled in the art, the polishing pads of the present disclosure may be integrally formed and can be formed according to a variety of methods including, e.g., molding, extruding, embossing, and combinations thereof.

In some embodiments, the present disclosure may be further directed to polishing pad arrangements that include the above described polishing pads and one or more additional layers. For example, the polishing pads may include adhesive layers such as pressure sensitive adhesives, hot melt adhesives, or epoxies. "Sub pads" such as thermoplastic or thermoset layers, e.g. polycarbonate layers, which may impart greater stiffness to the pad, may be used for global planarity by, for example, coupling to the bottom major surface 40A of the polishing pads 40. Sub pads may also include compressible material layers, e.g., foamed material layers. Sub pads which include combinations of both thermoplastic and compressible material layers may also be used. Additionally, or alternatively, metallic films for static elimination or sensor signal monitoring, optically clear layers for light transmission, foam layers for finer finish of the workpiece, or ribbed materials for imparting a "hard band" or stiff region to the polishing surface may be included.

While the previous embodiments have been described with respect to polishing pads having a base layer that is planar, it is to be appreciated that any number of non-planar orientations may be employed without deviating from the scope of the preset disclosure. For example, the base layer may be in the form of continuous belt. As additional examples, the base layer may be provide in a propeller like configuration or as a bundle of festoons. Of course, such non-planar polishing pads could be coupled to an appropriate carrier assembly (e.g., platen or axel) that is capable of rotating the polishing pad such that it contacts the substrate to be polished.

In further embodiments, the polishing pads can be provided to the polishing system in a real-to-reel fashion such that worn or used portions can be advances and replaced. The reel to reel dispensing system can be fixture such that the system moves in synchronicity with the polishing pad.

The present disclosure further relates to polishing fluids that may used, along with the polishing pads of the present disclosure, in a polishing operation. In some embodiments, the polishing solutions (depicted as reference number 50 in FIG. 1, and commonly referred to as a "slurry") of the present disclosure may include a fluid component having abrasive composites dispersed and/or suspended therein.

In various embodiments, the fluid component may be non-aqueous or aqueous. A non-aqueous fluid is defined as having at least 50% by weight of a non-aqueous fluid, e.g., an organic solvent. An aqueous fluid is defined as having at least 50% by weight water. Non aqueous fluid components may include alcohols; e.g., ethanol, propanol, isopropanol, , carbowax, petrolatum,butanol, triacetin, diacetin , acetin, ethylene glycol, propylene glycol, glycerol, polyethylene glycol, triethylene glycol; acetates, e.g. ethyl acetate, butyl acetate; ketones, e.g. methyl ethyl ketone, organic acids, e.g., acetic acid, fatty acids such as animal fats, vegetable oil, peanut oil, palm oil; ethers; triethanolamine; complexes of triethanolamine such as silitrane or boron equivalents, or combinations thereof. Aqueous fluid components may include (in addition to water) non-aqueous fluid components, including any of the non-aqueous fluids described above. The fluid component may consist essentially of water, or the amount of water in the fluid component may be at least 50% by weight, at least 70% by weight, at least 90% by weight or at least 95% by weight. The fluid component may consist essentially of a non-aqueous fluid, or the amount of non-aqueous fluid in the fluid component may be at least 50% by weight, at least 70% by weight, at least 90% by weight or at least 95% by weight. When the fluid component includes both aqueous and non-aqueous fluids, the resulting fluid component may be homogeneous, i.e. a single phase solution.

In alternative embodiments, the fluid component may include or be formed of petrolatum, mineral oil grease, polyethylene glycol, triethylene glycol, ethylene glycol, propylene glycol, glycerol, or the like. These materials may be rheologically modified with additives such as fumed silica, organo-modified clays, surfactants, functionalized nanoparticles, or polymers to achieve a fluid component having a paste-like consistency. The paste-like fluid component may behave as a semi-solid, having essentially an infinite viscosity when quiescent but exhibiting dramatic shear thin when a yield stress is exceeded. This highly thixotropic behavior may allow for the polishing solution to be maintained on the polishing pad and substrate, yet flowable during processing such that the abrasive composites can polish the substrate.

In illustrative embodiments, the fluid component may be selected such that the abrasive composite particles are insoluble in the fluid component.

In some embodiments, the fluid component may further include one or more additives such as, for example, dispersion aids, rheology modifiers, corrosion inhibitors, pH modifiers, surfactants, chelating agents/complexing agents, passivating agents, foam inhibitor, and combinations thereof. Dispersion aids are often added to prevent the sagging, settling, precipitation, and/or flocculation of the agglomerate particles within the slurry, which may lead to inconsistent or unfavorable polishing performance. Useful dispersants may include amine dispersants, which are reaction products of relatively high molecular weight aliphatic or alicyclic halides and amines, such as polyalkylene polyamines and Mannich dispersants, which are the reaction products of alkyl phenols in which the alkyl group contains at least 30 carbon atoms with aldehydes (especially formaldehyde) and amines (especially polyalkylene polyamines). Examples of amine dispersants are described in U.S. Pat. Nos. 3,275,554; 3,438,757; 3,454,555, and 3,565,804, all incorporated herein by reference. Examples of Mannich dispersants are described in U.S. Pat. Nos. 3,036,003; 3,236,770; 3,414,347; 3,448,047; 3,461,172; 3,539,633; 3,586,629; 3,591,598; 3,634,515; 3,725,480; 3,726,882, and 3,980,569, incorporated herein by reference.

Dispersive aids which provide steric stabilization may be used, such as those available under the trade designation SOLSPERSE, CARBOSPERSE and IRCOSPERSE, from Lubrizol Corporation, Wickliffe, Ohio. Additional dispersants include DISPERBYK additives such as DISPERBYK 180 from BYK Additives and Instruments, Wesel, Germany and DISPERS additives, including TEGO DISPERS 652, TEGO DISPERS 656 and TEGO DISPERSE 670, from Evonik Industries Hopewell, Virginia. Dispersion aids may be used alone or in combination of two or more.

Rheology modifiers may include shear thinning and shear thicknening agents. Shear-thinning agents may include polyamide waxes coated on polyolefin polymer material available under the trade designation DISPARLON from King Industries, Inc, Norwalk, Conn., including DISPARLON AQH-800, DISPARLON 6100, DISPARLON BB-102. Certain clays, such as Montmorillonite clay, may also be added as a shear thinning agent. Rheology modifiers may be used alone or in combination of two or more.

Thickening agents may include fumed silica, such as those available under the trade designation CAB-O-SIL from Cabot Corporation, Boston, Mass. and AEROSIL from Evonik Industires; SOLTHIX RHEOLOGY MODIFIERS and IRCOGEL from Lubrizol Corporation; water-soluble polymers, e.g. polyvinylpyrrolidone, polyethyleneimine, cellulose derivatives (hydroxypropylmethyl cellulose, hydroxyethyl cellulose, cellulose acetate butyrate, etc.) polyvinyl alcohol, poly(meth)acrylic acid, polyethylene glycol, poly(meth)acrylamide, polystyrene sulfonate, or any combinations thereof; non-aqueous polymers, e.g., polyolefins, styrene/maleic ester copolymers, and similar polymeric substances including homopolymers, copolymers and graft copolymers. The agents may comprise a nitrogen-containing methacrylate polymer, for example, a nitrogen-containing methacrylate polymer derived from methyl methacrylate and dimethylaminopropyl amine. Examples of commercially available materials include polyisobutylenes, such as INDOPAL from BP, London, England and or PARAPOL from ExxonMobil, Irving, Tex.; olefin copolymers, such as LUBRIZOL 7060, 7065, and 7067 from Lubrizol Corporation and LUCANT HC-2000L and LUCANT HC-600 from Mitsui Chemicals, Tokyo, Japan; hydrogenated styrene-diene copolymers, such as SHELLVIS 40 and SHELLVIS 50 from Shell Chemicals, Houston, Tex. and LZ 7308 and LZ 7318 from Lubrizol Corporation; styrene/maleate copolymers, such as LZ 3702 and LZ 3715 from Lubrizol Corporaton; polymethacrylates, such as those available under the trade designation VISCOPLEX from Evonik RohMax USA, Inc., Horsham, Pa., HITEC series of viscosity index improvers from Afton Chemical Corporation, Richmond, Va., and LZ 7702, LZ 7727, LZ7725 and LZ 7720C from Lubrizol Corporation; olefin-graft-polymethacrylate polymers such as VISCOPLEX 2-500 and VISCOPLEX 2-600 from Evonik RohMax USA, Inc.; and hydrogenated polyisoprene star polymers, such as SHELLVIS 200 and SHELLVIS 260, from Shell Chemicals. Other materials include methacrylate polymers with radial or star architecture, such as ASTERIC polymers from Lubrizol Corporation. Viscosity modifiers that may be used are described in U.S. Pat. Nos. 5,157,088; 5,256,752 and 5,395,539, incorporated herein by reference. Viscosity modifiers may be used alone or in combination of two or more.

Corrosion inhibitors that may be added to the fluid component include alkaline materials, which can neutralize the acidic byproducts of the polishing process that can degrade metal such as triethanolamine, fatty amines, octylamine octanoate, and condensation products of dodecenyl succinic acid or anhydride and a fatty acid such as oleic acid with a polyamine. Corrosions inhibitors may be used alone or in combination of two or more.

Suitable pH modifiers which may be used include alkali metal hydroxides, alkaline earth metal hydroxides, basic salts, organic amines, ammonia, and ammonium salts. Examples include potassium hydroxide, sodium hydroxide, calcium hydroxide, ammonium hydroxide, sodium borate, ammonium chloride, triethylamine, triethanolamine, diethanolamine, and ethylenediamine. Some pH modifiers, such as diethanolamine and triethanolamine, may also be capable of forming chelate complexes with metal impurities such as aluminum ions during metal polishing. Buffer systems may also be employed. The buffers can be adjusted to span the pH range from acidic to near-neutral to basic. Polyprotic acids act as buffers, and when fully or partially neutralized with ammonium hydroxide to make ammonium salts, they are representative examples including systems of phosphoric acid-ammonium phosphate; polyphosphoric acid-ammonium polyphosphate; the boric acid-ammonium tetraborate; boric acid-ammonium pentaboratepH modifiers may be used alone or in combination of two or more. Other buffers include tri- and potyprotic protolytes and their salts (e.g., ammonium salts). These may include ammonium ion buffer systems based on the following protolytes, all of which have at least one pKa greater than 7: aspartic acid, glutamic acid, histidine, lysine, arginine, ornithine, cysteine, tyrosine, and carnosine.

Surfactants that may be used include ionic and nonionic surfactants. Nonionic surfactants may include polymers containing hydrophilic and hydrophobic segments, such as poly(propylene glycol)-block-poly(ethylene glycol)-block-poly(propylene glycol) available under the trade designation PLURONIC from BASF Corporation, Florham Park, N.J.; poly(ethylene)-block-poly(ethylene glycol) available under the trade designation BRIJ from Croda International PLC, Edison, N.J.; nonylphenol ethoxylate available under the trade designation TERGITOL from Dow Chemical, Midland, Mich. and polyethylene glycol sorbitan monostearate available under the trade designation TWEEN 60 and other TWEEN surfactants from Croda International PLC.

Ionic surfactants may include both cationic surfactants and anionic surfactants. Cationic surfactants include quaternary ammonium salts, sulfonates, carboxylates, linear alkylamines. alkylbenzene sulfonates (detergents), (fatty acid) soaps, lauryl sulfates, di-alkyl sulfosuccinate and lignosulfonates. Anionic Surfactants are dissociated in water in an amphiphilic anion, and a cation, which is in general an alkaline metal (Na+, K+) or a quaternary ammonium. Types include Laureth-carboxylic acid such as AKYPO RLM-25 from KAO Chemicals, Kao Specialties Americas LLC, High Point, N.C. Surfactants may be used alone or in combination of two or more.

Complexing agents, such as ligands and chelating agents, may be included in the fluid component, particularly when the application relates to metal finishing or polishing, where metal swarf and or metal ions may be present in the fluid component during use. The oxidation and dissolution of metal can be enhanced by the addition of complexing agents. These compounds can bond to metal to increase the solubility of metal or metal oxides in aqueous and non-aqueousliquids, as generally described in Cotton & Wilkinson; and Hathaway in Comprehensive Coordination Chemistry, Vol. 5; Wilkinson, Gillard, McCleverty, Eds. Suitable additives that may be added to or used in the liquid component include monodentate complexing agents, such as ammonia, amines, halides, pseudohalides, carboxylates, thiolates, and the like also called ligands. Other additives that may be added to the working liquid include multidentate complexing agents, typically multidentate amines. Suitable multidentate amines include ethylenediamine, diethylene-triamine, triethylenetetramine, or combinations thereof. Combinations of the two monodentate and polydentate complexing agents include amino acids such as glycine, and common analytical chelating agents such as EDTA-ethylenediaminetetraacetic acid and its numerous analogs. Additional chelators include: polyphosphates, 1,3-diketones, aminoalcohols, aromatic heterocyclic bases, phenols, aminophenols, oximes, Schiff bases, and sulfur compounds. Examples of suitable complexing agents (particularly in the case when metal oxide surfaces are being polished) include ammonium salts such as $NH_4HCO_3$, tannic acid, catechol, $Ce(OH)(NO)_3$; $Ce(SO_4)_2$, phthalic acid, salicyclic acid and the like.

Complexing agents may include carboxylic acids and salts thereof that having one carboxyl group (i.e., monofunctional carboxylic acids) or a plurality of carboxylic acid groups (i.e., multifunctional carboxylic acids), e.g., difunctional carboxylic acids (i.e., dicarboxylic acids) and trifunctional carboxylic acids (i.e., tricarboxylic acids). As used herein, the terms "monofunctional", "difunctional", "trifunctional," and "multifunctional" refer to the number of carboxyl groups on the acid molecule. Complexing agents may include simple carboxylic acids, which consist of carbon, hydrogen, and one or more carboxyl groups. Exemplary monofunctional simple carboxylic acids include, e.g., formic, acetic, propionic, butyric, isobutyric acid, 3-butenoic acid, capric, lauric, stearic, oleic, linoleic, linolenic, phenylacetic, benzoic, and toluic acids. Exemplary multifunctional simple carboxylic acids include, e.g., oxalic, malonic, methylmalonic, succinic, glutaric, adipic, maleic, fumaric, phthalic, isophthalic, and terephthalic acids. Complexing agents may include substituted carboxylic acids contain one or more substituents, e.g., halides, hydroxyl groups, amino groups, ether groups, and/or carbonyl groups in addition to the one or more carboxyl groups. Hydroxy-carboxylic acids, which comprise one or more hydroxyl groups, are one class of substituted carboxylic acid. Exemplary hydroxy-carboxylic acids include monofunctional hydroxy-carboxylic acids and multifunctional hydroxy-carboxylic acids. Exemplary monofunctional hydroxy-carboxylic acids include glyceric acid (i.e., 2,3-dihydroxypropanoic acid), glycolic acid, lactic acid (e.g., L-lactic, D-lactic, and DL-lactic acids), hydroxy-butanoic acid, 3-hydroxypropionic acid, gluconic acid and methyllactic acid (i.e., 2-hydroxyisobutyric acid). Exemplary multifunctional hydroxy-carboxylic acids include malic acid and tartaric acid (difunctional hydroxy-carboxylic acids) and citric acid (a trifunctional hydroxy-carboxylic acid). Complexing agents may be used alone or in combination of two or more.

Passivating agents may be added to the fluid component to create a passivating layer on the substrate being polished, thereby altering the removal rate of a given substrate or adjusting the removal rate of one material relative to another material, when the substrate contains a surface that includes two or more different materials. Passivating agents known in the art for passivating metal substrates may be used, including benzotriazole and corresponding analogs. Passivating agents known to passivate inorganic oxide substrates, include amino acids, e.g. glycine, aspartic acid, glutamic acid, histidine, lysine, proline, arginine, cysteine, and tyronsine may be used. Additionally, ionic and non-ionic surfactants may also function as passivating agents. Passivating agents may be used alone or in combination of two or more, e.g. an amino acid and a surfactant.

Foam inhibitors that may be used include silicones; copolymers of ethyl acrylate and 2-ethylhexylacrylate, which can optionally further include vinyl acetate; and demulsifiers including trialkyl phosphates, polyethylene glycols, polyethylene oxides, polypropylene oxides and (ethylene oxide-propylene oxide) polymers. Foam inhibitors may be used alone or in combination of two or more. Other additives that may be useful in the fluid component include oxidizing and/or bleaching agents such as, e.g. hydrogen peroxide, nitric acid, and transition metal complexes such as ferric nitrate; lubricants; biocides; soaps and the like.

In various embodiments, the concentration of an additive class, i.e. the concentration of one or more additives from a single additive class, in the polishing solution may be at least about 0.01 wt. %, at least about, 0.1 wt. %, at least about 0.25 wt. %, at least about 0.5 or at least about 1.0 wt. %; less than about 20 wt. %, less than about 10 wt. %, less than about 5 wt. % or less than about 3 wt % based on the weight of the polishing solution.

In illustrative embodiments, the abrasive composites of the present disclosure may include porous ceramic abrasive composites. The porous ceramic abrasive composites may include individual abrasive particles dispersed in a porous ceramic matrix. As used herein the term "ceramic matrix" includes both glassy and crystalline ceramic materials. These materials generally fall within the same category when considering atomic structure. The bonding of the adjacent atoms is the result of process of electron transfer or electron sharing. Alternatively, weaker bonds as a result of attraction of positive and negative charge known as secondary bond can exist. Crystalline ceramics, glass and glass ceramics have ionic and covalent bonding. Ionic bonding is achieved as a result of electron transfer from one atom to another. Covalent bonding is the result of sharing valence electrons and is highly directional. By way of comparison, the primary bond in metals is known as a metallic bond and involves non-directional sharing of electrons. Crystalline ceramics can be subdivided into silica based silicates (such as fireclay, mullite, porcelain, and Portland cement), non-silicate oxides (e.g., alumna, magnesia, $MgAl_2O_4$, and zirconia) and non-oxide ceramics (e.g., carbides, nitrides and graphite). Glass ceramics are comparable in composition with crystalline ceramics. As a result of specific processing techniques, these materials do not have the long range order crystalline ceramics do.

In illustrative embodiments, at least a portion of the ceramic matrix includes glassy ceramic material. In further embodiments, the ceramic matrix includes at least 50% by weight, 70% by weight, 75% by weight, 80% by weight, or 90% by weight glassy ceramic material. In one embodiment, the ceramic matrix consists essentially of glassy ceramic material.

In various embodiments, the ceramic matrixes may include glasses that include metal oxides, for example, aluminum oxide, boron oxide, silicon oxide, magnesium oxide, sodium oxide, manganese oxide, zinc oxide, and mixtures thereof. A ceramic matrix may include alumina-borosilicate glass including $Si_2O$, $B_2O_3$, and $Al_2O_3$. The alumina-borosilicate glass may include about 18% $B_2O_3$, 8.5% $Al_2O_3$, 2.8% BaO, 1.1% CaO, 2.1% Na2O, 1.0% Li2O with the balance being Si2O. Such an alumina-borosilicate glass is commercially available from Specialty Glass Incorporated, Oldsmar Fla.

As used herein the term "porous" is used to describe the structure of the ceramic matrix which is characterized by having pores or voids distributed throughout its mass. The pores may be open to the external surface of the composite or sealed. Pores in the ceramic matrix are believed to aid in the controlled breakdown of the ceramic abrasive composites leading to a release of used (i.e., dull) abrasive particles from the composites. The pores may also increase the performance (e.g., cut rate and surface finish) of the abrasive article, by providing a path for the removal of swarf and used abrasive particles from the interface between the abrasive article and the workpiece. The voids may comprise from about at least 4 volume % of the composite, at least 7 volume % of the composite, at least 10 volume % of the composite, or at least 20 volume % of the composite; less than 95 volume % of the composite, less than 90 volume % of the composite, less than 80 volume % of the composite, or less than 70 volume % of the composite. A porous ceramic matrix may be formed by techniques well known in the art, for example, by controlled firing of a ceramic matrix precursor or by the inclusion of pore forming agents, for example, glass bubbles, in the ceramic matrix precursor.

In some embodiments, the abrasive particles may include diamond, cubic boron nitride, fused aluminum oxide, ceramic aluminum oxide, heated treated aluminum oxide, silicon carbide, boron carbide, alumina zirconia, iron oxide, ceria, garnet, and combinations thereof. In one embodiment, the abrasive particles may include or consist essentially of diamond. Diamond abrasive particles may be natural or synthetically made diamond. The diamond particles may have a blocky shape with distinct facets associated with them or, alternatively, an irregular shape. The diamond particles may be mono-crystalline or polycrystalline such as diamond commercially available under the trade designation "Mypolex" from Mypodiamond Inc., Smithfield Pa. Monocrystalline diamond of various particles size may be obtained from Diamond Innovations, Worthington, Ohio. Polycrystalline diamond may be obtained from Tomei Corporation of America, Cedar Park, Tex. The diamond particles may contain a surface coating such as a metal coating (nickel, aluminum, copper or the like), an inorganic coating (for example, silica), or an organic coating.

In some embodiments, the abrasive particles may include a blend of abrasive particles. For example, diamond abrasive particles may be mixed with a second, softer type of abrasive particles. In such instance, the second abrasive particles may have a smaller average particle size than the diamond abrasive particles.

In illustrative embodiments, the abrasive particles may be uniformly (or substantially uniformly) distributed throughout the ceramic matrix. As used herein, "uniformly distributed" means that the unit average density of abrasive particles in a first portion of the composite particle does not vary by more than 20%, more than 15%, more than 10%, or more than 5% when compared with any second, different portion of the composite particle. This is in contrast to, for example, an abrasive composite particle having abrasive particles concentrated at the surface of the particle.

In various embodiments, the abrasive composite particles of the present disclosure may also include optional additives such as fillers, coupling agents, surfactants, foam suppressors and the like. The amounts of these materials may be selected to provide desired properties. Additionally, the abrasive composite particles may include (or have adhered to an outer surface thereof) one or more parting agents. As will be discussed in further detail below, one or more parting agents may used in the manufacture of the abrasive composite particles to prevent aggregation of the particles. Useful parting agents may include, for example, metal oxides (e.g., aluminum oxide), metal nitrides (e.g., silicon nitride), graphite, and combinations thereof.

In some embodiments, the abrasive composites useful in the articles and methods of the present disclosure may have an average size (average major axial diameter or longest straight line between two points on a composite) of about at least 5 μm, at least 10 μm, at least 15 μm, or at least 20 μm; less than 1,000 μm, less than 500 μm, less than 200 μm, or less than 100 μm.

In illustrative embodiments, the average size of the abrasive composites is at least about 3 times the average size of the abrasive particles used in the composites, at least about 5 times the average size of the abrasive particles used in the composites, or at least about 10 times the average size of the abrasive particles used in the composites; less than 30 times the average size of the abrasive particles used in the composites, less than 20 times the average size of the abrasive particles used in the composites, or less than 10 times the average size of the abrasive particles used in the composites. Abrasive particles useful in the articles and methods of the present disclosure may have an average particle size (average major axial diameter (or longest straight line between two points on a particle)) of at least about 0.5 μm, at least about 1 μm, or at least about 3 μm; less than about 300 μm, less than about 100 μm, or less than about 50 μm. The abrasive particle size may be selected to, for example, provide a desired cut rate and/or desired surface roughness on a workpiece. The abrasive particles may have a Mohs hardness of at least 8, at least 9, or at least 10.

In various embodiments, the weight of abrasive particles to the weight of glassy ceramic material in the ceramic matrix of the ceramic abrasive composites is at least about 1/20, at least about 1/10, at least about 1/6, at least about 1/3, less than about 30/1, less than about 20/1, less than about 15/1 or less than about 10/1.

In various embodiments, the amount of porous ceramic matrix in the ceramic abrasive composites is at least 5, at least 10, at least 15, at least 33, less than 95, less than 90, less than 80, or less than 70 weight percent of the total weight of the porous ceramic matrix and the individual abrasive particles, where the ceramic matrix includes any fillers, adhered parting agent and/or other additives other than the abrasive particles In various embodiments, the abrasive composite particles may be precisely-shaped or irregularly shaped (i.e., non-precisely-shaped). Precisely-shaped ceramic abrasive composites may be any shape (e.g., cubic, block-like, cylindrical, prismatic, pyramidal, truncated pyramidal, conical, truncated conical, spherical, hemispherical, cross, or post-like). The abrasive composite particles may be a mixture of different abrasive composite shapes and/or sizes. Alternatively, the abrasive composite particles may have the same (or substantially the same) shape and/or size. Non-precisely shaped particles include spheroids, which may be formed from, for example, a spray drying process.

In various embodiments, the concentration of the abrasive composites in the fluid component may be at least 0.065 wt. %, at least 0.16 wt. %, at least 0.33 or at least 0.65 wt. %; less than 6.5 wt. %, less than 4.6 wt. %, less than 3.0 wt. % or less than 2.0 wt %. In some embodiments, both the ceramic abrasive composites and the parting agent used in their fabrication can be included in the fluid component. In these embodiments the concentration of the abrasive composites and the parting agent in the fluid component may be at least 0.1 wt. %, at least 0.25 wt. %, at least 0.5 or at least 1.0 wt. %; less than 10 wt. %, less than 7 wt. %, less than 5 wt. % or less than 3 wt.

The abrasive composite particles of the present disclosure may be formed by any particle forming processes including, for example, casting, replication, microreplication, molding, spraying, spray-drying, atomizing, coating, plating, depositing, heating, curing, cooling, solidification, compressing, compacting, extrusion, sintering, braising, atomization, infiltration, impregnation, vacuumization, blasting, breaking (depending on the choice of the matrix material) or any other available method. The composites may be formed as a larger article and then broken into smaller pieces, as for example, by crushing or by breaking along score lines within the larger article. If the composites are formed initially as a larger body, it may be desirable to select for use fragments within a narrower size range by one of the methods known to those familiar with the art. In some embodiments, the ceramic abrasive composites may include vitreous bonded diamond agglomerates produced generally using the method of U.S. Pat. Nos. 6,551,366 and 6,319,108, which is herein incorporated by reference in its entirety.

Generally, a method for making the ceramic abrasive composite includes mixing an organic binder, solvent, abrasive particles, e.g., diamond, and ceramic matrix precursor particles, e.g., glass frit; spray drying the mixture at elevated temperatures producing "green" abrasive/ceramic matrix/binder particles; the "green" abrasive/ceramic matrix/binder particles are collected and mixed with a parting agent, e.g., plated white alumina; the powder mixture is then annealed at a temperature sufficient to vitrify the ceramic matrix material that contains the abrasive particles while removing the binder through combustion; forming the ceramic abrasive composite. The ceramic abrasive composites can optionally be sieved to the desired particle size. The parting agent prevents the "green" abrasive/ceramic matrix/binder particles from aggregating together during the vitrifying process. This enables the vitrified, ceramic abrasive composites to maintain a similar size as that of the "green" abrasive/ceramic matrix/binder particles formed directly out of the spray drier. A small weight fraction, less than 10%, less 5% or even less than 1% of the parting agent may adhere to the outer surface of the ceramic matrix during the vitrifying process. The parting agent typically has a softening point (for glass materials and the like), or melting point (for crystalline materials and the like), or decomposition temperature, greater than the softening point of the ceramic matrix, wherein it is understood that not all materials have each of a melting point, a softening point, or a decomposition temperature. For a material that does have two or more of a melting point, a softening point, or a decomposition temperature, it is understood that the lower of the melting point, softening point, or decomposition temperature is greater than the softening point of the ceramic matrix. Examples of useful parting agents include, but are not limited to, metal oxides (e.g. aluminum oxide), metal nitrides (e.g. silicon nitride) and graphite.

In some embodiments, the abrasive composite particles of the present disclosure may be surface modified (e.g., covalently, ionically, or mechanically) with reagents which will impart properties beneficial to abrasive slurries. For example, surfaces of glass can be etched with acids or bases to create appropriate surface pH. Covalently modified surfaces can be created by reacting the particles with a surface treatment comprising one or more surface treatment agents. Examples of suitable surface treatment agents include silanes, titanates, zirconates, organophosphates, and organosulfonates. Examples of silane surface treatment agents suitable for this invention include octyltriethoxysilane, vinyl silanes (e.g., vinyltrimethoxysilane and vinyl triethoxysilane), tetramethyl chloro silane, methyltrimethoxysilane, methyltriethoxysilane, propyltrimethoxysilane, propyltriethoxysilane, tris-[3-(trimethoxysilyl)propyl] isocyanurate, vinyl-tris-(2-methoxyethoxy)silane, gamm-methacryloxypropyltrimethoxysilane, beta-(3,4-epoxycyclohexyl)ethyltrimethoxysilane, gamma-glycidoxypropyltrimethoxysilane gamma-mercaptopropyltrimethoxysilane, gamma-aminopropyltriethoxysilane, gamma-aminopropyltrimethoxysilane, N-beta-(aminoethyl)-gamma-aminopropyltrimethoxysilane, bis-(gamma-trimethoxysilylpropyl)amine, N-phenyl-gamma-aminopropyltrimethoxysilane, gamma-ureidopropyltrialkoxysilane, gamma-ureidopropyltrimethoxysilane, acryloxyalkyl trimethoxysilane, methacryloxyalkyl trimethoxysilane, phenyl trichlorosilane, phenyltrimethoxysilane, phenyl triethoxysilane, SILQUEST A1230 proprietary non-ionic silane dispersing agent (available from Momentive, Columbus, Ohio) and mixtures thereof. Examples of commercially available surface treatment agents include SILQUEST A174 and SILQUEST A1230 (available from Momentive). The surface treatment agents may be used to adjust the hydrophobic or hydrophilic nature of the surface it is modifying. Vinyl silanes can be used to provide an even more sophisticated surface modification by reacting the vinyl group w/ another reagent. Reactive or inert metals can be combined with the glass diamond particles to chemically or physically change the surface. Sputtering, vacuum evaporation, chemical vapor deposition (CVD) or molten metal techniques can be used.

In some embodiments, the present disclosure further relates to a second polishing solution, or finishing polishing solution, which, as will be discussed in further detail below, is intended for use during a final stage of a polishing operation. The second polishing solution may include any of the above-described polishing solutions, and may include an abrasive particle concentration that is 30%, 40%, 50%, 60%, 70%, 80%, 90% or 100% less than the first polishing solution (i.e., be substantially free of abrasive material). In various embodiments, the fluid component of the second polishing solution is the same as or substantially the same as the fluid component of the first polishing solution.

The present disclosure further relates to methods of polishing substrates. The methods may be carried out using a polishing system such as that described with respect to FIG. 1, or with any other conventional polishing system, e.g. single or double sided polishing and lapping. In some embodiments, a method of polishing substrate may include providing a substrate to be polished. The substrate may be any substrate for which polishing and/or planarization is desirable. For example, the substrate may be a metal, metal alloy, metal oxide, ceramic, or polymer (commonly in the form of a semiconductor wafer or optical lens). In some embodiments, the methods of the present disclosure may be particularly useful for polishing ultrahard substrates such as sapphire (A, R, or C planes), silicon, silicon carbide, quartz, or silicate glasses. The substrate may have one or more surfaces to be polished.

In various embodiments, the method may further include providing a polishing pad and a polishing solution. The polishing pad and polishing solution may be the same as or similar to any of the polishing pads and the polishing solutions described above.

In some embodiments, the method may further include contacting a surface of the substrate with the polishing pad and the polishing solution while there is relative motion between the polishing pad and the substrate. For example, referring again to the polishing system of FIG. 1, the carrier assembly 30 may apply pressure to the substrate 12 against a polishing surface of the polishing pad 40 (which may be coupled to the platen 20) in the presence of the polishing solution 50 as the platen 20 is moved (e.g., translated and/or rotated) relative to the carrier assembly 30. Additionally, the carrier assembly 30 may be moved (e.g., translated and/or rotated) relative to the platen 20. As a result of the pressure and relative motion, the abrasive particles (which may be contained in/on the polishing pad 40 and/or the polishing solution 50) may remove material from the surface of the substrate 12. In embodiments in which the polishing pad comprises a top major surface that includes polishing elements, the polishing pad may be coupled to the platen such that the top major surface will function as the polishing/working surface (i.e., the top major surface is positioned further from the platen than the bottom major surface).

In some embodiments, after the polishing method has been carried out for a desired period, the methods of the present disclosure may further include adjusting either or both of a flow rate at which the slurry is provided to the polishing system and the composition of the polishing solution (i.e., providing a second polishing solution) such that the amount of abrasive particles that are available for polishing may be reduced during a final stage of polishing. For example, the flow rate of the slurry may be reduced by 30%, 40%, 50%, 60%, 70%, 80%, 90% or 100% relative to an initial rate of the first polishing solution. As an additional example, a second polishing solution may be provided as the polishing solution, the second polishing solution having an abrasive particle concentration that is 30%, 40%, 50%, 60%, 70%, 80%, 90% or 100% less than the first polishing solution (i.e., be substantially free of abrasive material). In some embodiments, the second polishing solution may have an abrasive particle concentration of less than 0.5 wt. %, less than 0.3 wt. % or less than 0.1% wt. %.

In illustrative embodiments, the systems and methods of the present disclosure are particularly suited for the finishing of ultra hard substrates such as sapphire, A, R, or C planes. Finished sapphire crystals, sheets or wafers are useful, for example, in the light emitting diode industry and cover layer for mobile hand held devices. In such applications, the systems and methods provide persistent removal of material.

Furthermore, it has been discovered that systems and methods of the present disclosure can provide a removal rate commensurate with that achieved with large abrasive particle sizes conventionally employed, while providing a surface finish comparable to that achieved with small particle sizes conventionally employed. Still further, the systems and methods of the present disclosure are capable of providing persistent removal rates without extensive dressing of the pad, such as required with fixed abrasive pads.

Listing of Embodiments

1. A system for polishing a substrate: the system comprising:
   - a first carrier assembly configured to receive and hold the substrate;
   - a polishing pad comprising:
     - a top major surface and a bottom major surface positioned opposite the top major surface;
     - a plurality of polishing elements extending from the top major surface of the polishing pad;
   - a polishing solution disposed between the top surface of the polishing pad and the substrate, wherein the polishing solution comprises:
     - a fluid component, and
     - a plurality of ceramic abrasive composites dispersed in the fluid component, the ceramic abrasive composites comprising individual abrasive particles dispersed in a porous ceramic matrix; and
   - a second carrier assembly configured to receive and hold the polishing pad;
   - wherein the polishing pad is coupled to the second carrier assembly such that the top surface of the polishing pad is adjacent a surface of the substrate; and
   - wherein the system is configured such that the polishing pad is movable relative to the substrate to carry out a polishing operation.
2. The system for polishing a substrate according to embodiment 1, wherein the polishing elements comprise a stem having a first height and a first thickness, and a polishing head disposed distally with respect to the stem and having a second height and a second thickness.
3. The system for polishing a substrate according to embodiment 2, wherein the ratio of the first height to the first thickness is greater than 1.

4. The system for polishing a substrate according to any one of embodiments 2-3, wherein the first height is between 2 mm and 0.2 mm.
5. The system for polishing a substrate according to any one of embodiments 2-4, wherein the second height is between 0.3 mm and 0.05 mm, and the second thickness is between 0.2 mm and 0.6 mm.
6. The system for polishing a substrate according to any one of the previous embodiments, wherein the polishing elements are integrally formed with the top major surface.
7. The system for polishing a substrate according to any one of the previous embodiments, wherein the polishing elements are uniformly distributed about the top major surface.
8. The system for polishing a substrate according to any one of the previous embodiments, wherein the polishing elements are uniformly distributed about the top major surface.
9. The system for polishing a substrate according to any one of the previous embodiments, wherein the polishing elements are formed of polypropylene.
10. The system for polishing a substrate according to any one of the previous embodiments, wherein the distance between the top major surface and the bottom major surface is between 0.2 mm and 7 mm.
11. The system for polishing a substrate according to any one of the previous embodiments, further comprising a plurality of cavities that extend from the top major surface through bottom major surface.
12. The system for polishing a substrate according to any one of the previous embodiments, wherein the polishing pad further comprises a subpad, the subpad being coupled to the bottom major surface, and disposed between the bottom major surface and the platen.
13. The system according to any one of the previous embodiments, wherein the ceramic abrasive composites have a pore volume ranging from about 4-70%.
14. The system according to any one of the previous embodiments, wherein the abrasive particles comprise diamond, cubic boron nitride, fused aluminum oxide, ceramic aluminum oxide, heated treated aluminum oxide, silicon carbide, boron carbide, alumina zirconia, iron oxide, ceria, or garnet.
15. The system according to any one of the previous embodiments, wherein the abrasive particles comprise diamond.
16. The system according to any one of the previous embodiments, wherein the ceramic abrasive composites have an average particle size of less than 500 microns.
17. The system according to any one of the previous embodiments, wherein the average size of the ceramic abrasive composites is at least about 5 times the average size of the abrasive particles.
18. The system according to any one of the previous embodiments, wherein the porous ceramic matrix comprises glass comprising aluminum oxide, boron oxide, silicon oxide, magnesium oxide, sodium oxide, manganese oxide, or zinc oxide.
19. The system according to any one of the previous embodiments, wherein the concentration of the abrasive composites in the fluid component is between 0.065% and 6.5% by weight.
20. A method for polishing the surface of a substrate, the method comprising:

providing a substrate having a major surface to be polished providing a system for polishing a substrate according to any one of embodiments 1-18;

contacting the major surface of the substrate with the polishing pad and the polishing solution while there is relative motion between the polishing pad and the major surface of the substrate.

The operation of the present disclosure will be further described with regard to the following detailed examples. These examples are offered to further illustrate the various specific and preferred embodiments and techniques. It should be understood, however, that many variations and modifications may be made while remaining within the scope of the present disclosure.

EXAMPLES

Materials

| Materials | |
|---|---|
| Abbreviation or Trade Name | Description |
| MCD3A | A 3 micron monocrystalline diamond, available from World Wide Super Abrasives, Boynton Beach, Florida. |
| GF* | A glass frit having a particle size of about 10.6 microns, available under the trade designation "SP 1086" from Specialty Glass, Inc., Oldsmar, Florida. |
| AlOx | A 3 micron plated white alumina, available under the trade designation "PWA 3" from Fujimi Inc., Kiyosu, Japan. |
| Standex230 | Dextrin, available under the trade designation "STANDEX 230" from A. E. Staley Manufacturing Company, Decatur, Illinois. |
| TEG | Triethylene glycol, 99%, available from Sigma-Aldrich Co. LLC. |
| Carbopol Aqua 30 | Lubrizol Advanced Materials Inc., New Milford, CT., 06766 |
| Glycerol | ACS Reagent Grade >99.5%, Sigma Aldrich of Milwaukee WI, 53201 |
| Kathon CG/ICP II | Rohm and Hass, Philadelphia PA. |
| Sodium hydroxide | ACS Reagent Grade >97.0%, Sigma Aldrich of Milwaukee WI, 53201 |
| Polyethylene glycol methyl ether 750 | ACS Reagent Grade >99.5%, Sigma Aldrich of Milwaukee WI, 53201 |
| Petrolatum | ACS Reagent Grade >99.5%, Sigma Aldrich of Milwaukee WI, 53201 |
| Laponite RD | Silicate rheology modifier available from BYK USA, Wallingford CT |

-continued

| Materials | |
|---|---|
| Abbreviation or Trade Name | Description |
| Vegetable oil | Pure vegetable oil available from Essential Everyday |
| Sodium hydroxide | Sodium hydroxide pellets available from Avantor Performance Materials Inc, Center Valley PA |

*Particle size is the mean measured by conventional laser light scattering.

Polishing Test Method-1

Polishing was conducted using a Peter Wolters AC 500 double-sided lapping tool, available from Lapmaster Wolters, Rendsburg, Germany. A 18.31 inch (46.5 cm) outer diameter, 7 inch (17.8 cm) inner diameter pad was mounted to the 18.31 inch (46.5 cm) outer diameter, 7 inch (17.8 cm) inner diameter bottom platen, of the polisher using a double sided PSA. The top pad was similar except for 16×1 cm slurry holes that were aligned to the hole pattern of the top platen to allow for slurry to travel to the workpiece and bottom pad. The platens were rotated at 60 rpm both in a clockwise direction. Three epoxy glass carriers comprising three, round holes, each sized to hold a 5.1 cm diameter wafer, were set onto the bottom pad and aligned to the tool gears. The recess center points were located equal distance from each other and were offset relative to the center of the carrier, such that when the carriers rotated, the center point of each triangular shaped recess would rotate in a circle with 1 cm of a wafer edge overhanging the pad/platen edge. Three, A-plane sapphire wafers, 5.1 cm diameter×0.5 cm thick, were mounted in eachof the 3 carrier recesses and polished. Three carriers per batch for a total of 9 wafers per batch were run for 30 minutes. The highest load was applied to the wafers to achieve polishing pressure of 4 psi. The initial stage was set at 20 daN for 20 sec. with a rotational speed of 60 rpm running clockwise. The ring gear was set at 8, also in a clockwise direction. The second stage was set at 52 daN for 30 minutes with a final stage at 20 daN for 20 seconds. Slurry flow was constant at 6 g/min.

Wafers were measured gravimetrically before and after polishing. The measured weight loss was used to determine the amount of material removed, based on a wafer density of 3.98 g/cm$^3$. Removal rate, reported in microns/minute, is the average thickness reduction of the three wafers over the 30 minute polishing interval. Wafers were re-used for each 30 minute period.

Polishing Test Method-2

Polishing was conducted using a Engis Model FL 15 single-sided lapping tool, available from Engis Corp. of 105 W. Hinz Rd., Wheeling , Ill. 60090. A 15 inch (38.1 cm) diameter pad was mounted to the 15 inch (38.1 cm) diameter platen of the polisher using a double sided PSA. The platen was rotated at 50 rpm. The head of the polisher was rotated at 40 rpm, without a sweeping motion. A carrier comprising three, equilateral, triangular shaped recesses, each sized to hold a 5.1 cm diameter wafer, was mounted to the head. The recess center points were located equal distance from each other and were offset relative to the center of the head, such that when the head rotated, the center point of each triangular shaped recess would rotate in a circle having a 13.5 cm circumference. Three, A-plane sapphire wafers, 5.1 cm diameter×0.5 cm thick, were mounted in the carrier recesses and polished. Polishing time was 30 minutes. The load was applied to the wafers using weights of 30.7 lbs (13.9 kg) to achieve polishing pressure of 4 psi. The slurry flow rate was 1 g/min and dripped onto the pad at a point about 4 cm from the pad center. Wafers were measured gravimetrically before and after polishing. The measured weight loss was used to determine the amount of material removed, based on a wafer density of 3.98 g/cm$^3$. Removal rate, reported in microns/minute, is the average thickness reduction of the three wafers over the 30 minute polishing interval. Wafers were re-used for each 30 minute period.

Polishing Test Method-3

Polishing was conducted on the Gerber Optical Apex Finer/Polisher, available from Gerber Coburn. A 1×1 inch square pad was mounted on the top fixture set to an amplitude of zero. A 2 inch round A-plane sapphire wafer was placed on the bottom fixture which set to vibrate at high setting (measured at a frequency of 1150 Hz). A pressure of 3.5 psi was applied. Polishing paste was applied to the pad, and smeared on the sapphire wafer. Polishing occurred for a period of 30 mins. Sapphire wafer weights before and after polishing was measured. Removal rates in μm/min was calculated assuming uniform stock removal from the surface of the 2 inch wafer.

Preparation of Slurry-1

A slurry was prepared by forming a glycerol/water solution containing 5 g CAC-1 and 995 g Lubricant. The solution was mixed using a conventional high shear mixer for about 3 minutes prior to use.

Preparation of Slurry-2

A slurry was prepared by forming a glycerol/water solution containing 10 g CAC-1 and 990 g Lubricant. The solution was mixed using a conventional high shear mixer for about 3 minutes prior to use.

Preparation of Paste-1

A grease/paste was prepared by adding 18.2 g petrolatum, 1.2 g vegetable oil and 0.6 g CAC-1 in a 4 oz jar. Using a heat gun, the mixture was heated until the petrolatum melted. Once melted, the jar mixture was swirled until the suspension was well mixed, then allowed to cool while swirling. Upon cooling, the polishing grease/paste is formed.

Preparation of Paste-2

19.4 PEG 750 was mixed with 0.6 g CAC-1. The mixture was heated until the PEG melted, and the mixture was swirled until a uniform suspension formed. Upon cooling a polishing paste/wax formed.

Preparation of Paste-3

50.0 g of DI water was mixed with 50.3 g of glycerol in an 8 oz jar. 3.21 g of CAC-1 was added and mixed with a propeller blade for 1 min. This was followed by the addition of 2.0 g Laponite RD over about 30 seconds while mixing. 1.5 g Aqua 30 was added next while mixing. The final component, an 18% NaOH solution, was added at the end. The components were allowed to mix for 5 mins.

Example of Polishing Pad-1a Having Plurality of Polishing Elements with Convex Head Shape A 25×25 in. sheet of polypropylene material containing convex polishing elements, 41-9104-3120-8, was laminated onto a sheet of 442 kw double sided adhesive, with the polishing element surface facing upwards relative to standard planarization system, so as to face toward the workpiece and incident slurry flow. This pad was then die cut to fit the appropriate tool platen for the single-sided polishing system.

Comparative Example Polishing Pad-1b Having Polishing Layer with Plurality of Polishing Elements Inverted so as to Present Near Planar Polishing Surface A 25×25 in. sheet of polypropylene material containing convex polishing elements, 41-9104-3120-8, was laminated onto a sheet of 442 kw double sided adhesive, with the polishing element surface facing downwards relative to standard planarization system, so as to face away from the workpiece and incident slurry flow. The resulting work surface represents near planar polishing surface to the workpiece and slurry. This pad was then die cut to fit the appropriate tool platen for the single-sided polishing system.

Example of polishing pad-1c having plurality of polishing elements with convex head shape and epoxy filled stem volume A 25×25 in. sheet of polypropylene material containing convex polishing elements, 41-9104-3120-8, was coated with DP-125 Scotchweld Epoxy and the resin was leveled with a squeegee such that the epoxy resin was substantially filling the stem volume to just beneath the polishing element heads. After a 24 hr room temperature cure the coated sheet was laminated onto a sheet of 442 kw double sided adhesive, with the polishing element surface facing upwards relative to standard planarization system, so as to face toward the workpiece and incident slurry flow. This pad was then die cut to fit the appropriate tool platen for the single-sided polishing system.

Example of Polishing Pad-1d Having Plurality of Polishing Elements with Convex Head Shape A 1×1 in. sheet of polypropylene material containing convex polishing elements , 41-9104-3120-8, was laminated onto an equal size sheet of 442 kw double sided adhesive/ 30 mil polycarbonate/442 kw, with the polishing element surface facing upwards relative to standard planarization system, so as to face toward the workpiece. This pad was then die cut to fit the appropriate tool platen for the single-sided polishing system.

Example of Polishing Pad-1e and Pad-1f are Replicates of Polishing Pad 1d, Described above The following table provides overview of above-mentioned examples and comparative examples and compares conditions for Polishing Test:

| | Polishing Test Matrix: | | | | | polishing | | epoxy |
|---|---|---|---|---|---|---|---|---|
| | Polish test method: | Pad | Slurry/ Paste | Polycarbonate backing layer | polishing layer material | layer head shape | Inverted polishing layer | filled stem volume |
| Example 1AC PC | 1 | 1 AC PC | slurry 1 | Yes | Polypropylene | convex | No | No |
| Example 1AC No PC | 1 | 1 AC No PC | slurry 1 | No | Polypropylene | convex | No | No |
| Example 1a | 2 | 1a | slurry 1 | No | Polypropylene | convex | No | No |
| Comp. Example 1b | 2 | 1b | slurry 1 | No | Polypropylene | convex | Yes | No |
| Example 1c | 2 | 1c | slurry 1 | No | Polypropylene | convex | No | Yes |
| Example 1d | 3 | 1d | paste 1 | Yes | Polypropylene | convex | No | No |
| Example 1e | 3 | 1e | paste 2 | Yes | Polypropylene | convex | No | No |
| Example 1f | 3 | 1f | paste 3 | Yes | Polypropylene | convex | No | No |
| Example 2 | 2 | 2 | slurry 2 | No | Polypropylene | concave | No | No |
| Comp. Example 3 | 2 | 3 | slurry 2 | No | Polypropylene | concave | Yes | No |
| Example 4 | 2 | 4 | slurry 2 | No | Polypropylene | concave | No | Yes |
| Example 5 | 2 | 5 | slurry 1 | No | Polypropylene | stem-like (ie no head) | No | No |
| Example 6 | 2 | 6 | slurry 1 | No | Urethane | stem-like (ie no head) | No | No |

Polishing test-1AC PC was run using Pad-1ACPC, Polishing Test Method-1, Removal Rate Test Method-1 and Slurry-1.

Polishing test-1AC NOPC was run using Pad-1ACNOPC and Polishing Test Method-1 and Removal Rate Test Method-1, Slurry-1.

Polishing Test -1a was run using Pad-1a and Polishing Test Method-2 and Removal Rate Test Method-1, Slurry-1.

Polishing Test -1b was run using Pad-1b and Polishing Test Method-2 and Removal Rate Test Method-1, Slurry-1.

Polishing Test -1c was run using Pad-1c and Polishing Test Method-2 and Removal Rate Test Method-1, Slurry-1.

Polishing Test -1d was run using Pad-1d and Polishing Test Method-3 and Removal Rate Test Method-1, Paste-1.

0.65 g of Paste-1 was applied to the pad, and 1.6g smeared on the sapphire wafer.

Polishing Test -1e was run using Pad-1e and Polishing Test Method-3 and Removal Rate Test Method-1, Paste-2.

1.7 g of Paste-2 was applied to the pad, and 2.5 g smeared on the sapphire wafer.

Polishing Test -1f was run using Pad-1f and Polishing Test Method-3 and Removal Rate Test Method-1, Paste-3.

1.5 g of Paste-3 was applied to the pad, and 2.5 g smeared on the sapphire wafer.

Polishing Test -2 was run using Pad-2 and Polishing Test Method-2 and Removal Rate Test Method-1, Slurry-2.

Polishing Test -3 was run using Pad-3 and Polishing Test Method-2 and Removal Rate Test Method-1, Slurry-2.

Polishing Test -4 was run using Pad-4 and Polishing Test Method-2 and Removal Rate Test Method-1, Slurry-2.

Polishing Test -5 was run using Pad-5 and Polishing Test Method-2 and Removal Rate Test Method-1, Slurry-1.

Polishing Test -6 was run using Pad-6 and Polishing Test Method-2 and Removal Rate Test Method-1, Slurry-1.

| | Measured Results: | | |
|---|---|---|---|
| | Avg removal rate [micron/min] | Ra [nm] | Rt [nm] |
| Example 1AC PC | 0.84 | 19 | 270 |
| Example 1AC No PC | 0.56 | | |
| Example 1a | 0.73 | | |
| Comp. Example 1b | 0.38 | | |
| Example 1c | 0.4 | | |
| Example 1d | 0.8 | 34 | |
| Example 1e | 1 | 26 | |
| Example 1f | 0.5 | 19 | |
| Example 2 | 0.65 | 28 | 1180 |
| Comp. Example 3 | 0.51 | 28 | 890 |
| Example 4 | 0.56 | 28 | 450 |
| Example 5 | 0.81 | | |
| Example 6 | 0.01 | | |

Other embodiments of the invention are within the scope of the appended claims.

What is claimed is:

1. A system for polishing a substrate: the system comprising:

a first carrier assembly configured to receive and hold the substrate;

a polishing pad comprising:

a top major surface and a bottom major surface positioned opposite the top major surface;

a plurality of polishing elements extending from the top major surface of the polishing pad, wherein the polishing elements comprise a stem having a first height and a first thickness, and a polishing head disposed distally with respect to the stem and having a second height and a second thickness, and wherein the second thickness is greater then the first thickness;

a polishing solution disposed between the top surface of the polishing pad and the substrate, wherein the polishing solution comprises:

a fluid component, and a plurality of ceramic abrasive composites dispersed in the fluid component, the ceramic abrasive composites comprising individual abrasive particles dispersed in a porous ceramic matrix; and a second carrier assembly configured to receive and hold the polishing pad;

wherein the polishing pad is coupled to the second carrier assembly such that the top surface of the polishing pad is adjacent a surface of the substrate; and wherein the system is configured such that the polishing pad is movable relative to the substrate to carry out a polishing operation.

2. The system for polishing a substrate according to claim 1, wherein the ratio of the first height to the first thickness is greater than 1.

3. The system for polishing a substrate according to claim 2, wherein the first height is between 2 mm and 0.2 mm.

4. The system for polishing a substrate according to claim 1 wherein the second height is between 0.3 mm and 0.05 mm, and the second thickness is between 0.2 mm and 0.6 mm.

5. The system for polishing a substrate according to claim 1, wherein the polishing elements are integrally formed with the top major surface.

6. The system for polishing a substrate according to claim 1, wherein the polishing elements are uniformly distributed about the top major surface.

7. The system for polishing a substrate according to claim 1, wherein the polishing elements are uniformly distributed about the top major surface.

8. The system for polishing a substrate according to claim 1, wherein the polishing elements are formed of polypropylene.

9. The system for polishing a substrate according to claim 1, wherein the distance between the top major surface and the bottom major surface is between 0.2 mm and 7 mm.

10. The system for polishing a substrate according to claim 1, further comprising a plurality of cavities that extend from the top major surface through bottom major surface.

11. The system for polishing a substrate according to claim 1, wherein the polishing pad further comprises a subpad, the subpad being coupled to the bottom major surface, and disposed between the bottom major surface and the platen.

12. The system according to claim 1, wherein the ceramic abrasive composites have a pore volume ranging from about 4-70%.

13. The system according to claim 1, wherein the abrasive particles comprise diamond, cubic boron nitride, fused aluminum oxide, ceramic aluminum oxide, heated treated aluminum oxide, silicon carbide, boron carbide, alumina zirconia, iron oxide, ceria, or garnet.

14. The system according to claim 1, wherein the abrasive particles comprise diamond.

15. The system according to claim 1, wherein the ceramic abrasive composites have an average particle size of less than 500 microns.

16. The system according to claim 1, wherein the average size of the ceramic abrasive composites is at least about 5 times the average size of the abrasive particles.

17. The system according to claim 1, wherein the porous ceramic matrix comprises glass comprising aluminum oxide, boron oxide, silicon oxide, magnesium oxide, sodium oxide, manganese oxide, or zinc oxide.

18. The system according to claim 1, wherein the concentration of the abrasive composites in the fluid component is between 0.065% and 6.5% by weight.

19. A method for polishing the surface of a substrate, the method comprising:

providing a substrate having a major surface to be polished providing a system for polishing a substrate according to claim 1;

contacting the major surface of the substrate with the polishing pad and the polishing solution while there is relative motion between the polishing pad and the major surface of the substrate.

* * * * *